United States Patent [19]

Bueche'

[11] 4,125,006

[45] Nov. 14, 1978

[54] SHEET METAL FORMER

[76] Inventor: Clifford J. Bueche', P.O. Box 14426, San Antonio, Tex. 78214

[21] Appl. No.: 826,274

[22] Filed: Aug. 19, 1977

[51] Int. Cl.[2] ..... B21D 5/14

[52] U.S. Cl. ..... 72/169; 72/146; 72/388

[58] Field of Search ..... 72/146–148, 72/166, 169, 216, 459, 388, 387, 457, 463, 384, 320

[56] References Cited

U.S. PATENT DOCUMENTS

| | | | |
|---|---|---|---|
| 1,406,004 | 2/1922 | Hahnemann | 72/169 |
| 2,659,411 | 11/1953 | Bird | 72/146 X |
| 2,907,368 | 10/1959 | Barnes | 72/457 |

*Primary Examiner*—Milton S. Mehr
*Attorney, Agent, or Firm*—Gunn & Lee

[57] ABSTRACT

A sheet metal forming apparatus is shown with a plurality of various size and shaped rollers. The rollers are substantially parallel with a first end being open, and a second end being rotatably anchored and extending through a stationary bearing housing. A slot is provided in each roller along its longitudinal axis for receiving metal to be bent therein. After inserting metal into the slot of one of the rollers, the roller is turned by a handle on the second end. The roller is pre-indexed to turn a predetermined amount so that the metal is bent against an adjacent roller through a fixed arc. Subsequently, the bent metal may slide off the open end of the roller. A small roller may have a supporting bar extending parallel thereto with a supporting plate on the end thereof slideably receiving the first end of the small roller for additional strength. By a small longitudinal movement of the small roller, and pivoting the small roller in the stationary bearing housing, sheet metal bent thereon may be slid off the open first end.

9 Claims, 9 Drawing Figures

SHEET METAL FORMER

BACKGROUND OF THE INVENTION

The apparatus relates to a sheet metal former and, more particularly, to a sheet metal former commonly used in the trophy industry to bend the component parts located between the base and figure, which component parts are commonly called "columns", "bends" or "risers". To avoid confusion, hereinafter the formed metal will be referred to as a "column". A connecting rod normally extends longitudinally through the center of the column and connects the base to the figure with the column being securely located therebetween.

BRIEF DESCRIPTION OF THE PRIOR ART

Trophies are being given in just about every walk of life for almost anything and everything. A typical teenager by the time of graduation from high school may have severaltrophies to his or her credit. Trophies may be awarded for various accomplishments throughout one's life, which may include anything from a spelling bee championship, winning a baking contest, or being the office clown.

As the emphasis on trophies has increased, the number of trophy manufacturers has skyrocketed. However, contrary to many industries that have had a tendency to become very large with a few companies controlling the market, the trophy industry has basically remained as a group of independent proprietors with each owning and operating their individual trophy store. While the basic sheet metal used in forming the trophies, as well as any figure that would be mounted thereon, are normally purchased from a relatively small number of manufacturers, the individual store often forms, shapes and constructs each trophy. The base element may be made by the individual proprietor, or may be ordered from a relatively large number of alternate sources of supply. While the base elements a few years ago were usually wood, the trend is for the base element to be made out of marble or plastic. Through the various trophy shops, an individual can have made just about any type of trophy he would so desire.

As a result of each of the individual trophy shops making its own trophies, it has been virtually impossible to automate the trophy industry. Also, because each individual or organization wants its own particular individualized trophy, uniform trophies are often not acceptable in the trophy making industry. Therefore, as the individual trophy shop constructs its trophy, including the forming of the column, it is essential to have a very simple, economical, easy to operate sheet metal forming apparatus for the purpose of forming the columns. Normally, the columns are two sheets of metal curved on the outer edges and clamped together by retaining flanges. However, the method of forming each sheet comprising the column may be varied according to the preferences of the individual trophy shop and the purchaser. Prior methods of forming included pivotally securing a roller bar on each end thereof and the subsequent insertion of sheet metal to be formed into a slot of the roller. Thereafter, by turning the roller and having the sheet metal pressing against an adjacent roller or a fixed surface, the sheet metal could be formed. However, to remove the formed sheet metal from the roller, the roller had to be withdrawn before the sheet metal could be removed from one end thereof. This procedure was particularly time consuming thereby resulting in a significant increase in labor cost. Either different roller machines would have to be used for different size bends, or different rollers would have to be inserted into the machine currently being used.

Another problem with many of the prior roller machines used by trophy shops was that the individual had no fixed reference of how far an individual sheet of metal should be bent or through how many degrees of an arc the bend should extend for the proper forming of the column. It was often a hit-and-miss type of situation that depended upon the knowledge and skill of the individual trophy maker.

SUMMARY OF THE INVENTION

It is an object of the present invention to provide a sheet metal former.

It is another object of the present invention to provide an apparatus used in the construction of trophies or metal parts.

It is still another object of the present invention to provide an open end sheet metal former that may be used to form the edges of the sheet metal with the formed sheet metal being subsequently removed from the open end thereof. A plurality of rollers are pivotally mounted by one end extending through a stationary bearing housing. Each of the rollers has an individual slot along its longitudinal axis for receiving sheet metal to be bent therein. After inserting sheet metal in the slot, by rotation of the individual roller by a handle on the end thereof, sheet metal inserted into the slot is formed by pressing it against an adjacent roller. The roller is indexed to allow for turning through an arc of a predetermined size thereby insuring the proper bend of the sheet metal. After the sheet metal is formed on the edge thereof, it may be slid off the open end of the roller.

The rollers either have elongated bearings or a plurality of bearings in the stationary bearing housing to provide sufficient support for the roller. The method of lubricating the bearings is also provided. Small rollers which may have to be supported on each end for additional strength have an adjacent supporting rod with a supporting plate on the end thereof. The small roller is inserted into an opening of the supporting plate. By a fairly small movement along its longitudinal axis, the small roller may be pivoted to allow sheet metal formed thereon to be removed from an open end. An index key may be set on each individual roller so that once the sheet metal is inserted, the roller can only be turned through a predetermined arc thereby forming a certain size bend in the sheet metal. The indexing system may be reset according to the arc an individual trophy manufacturer desires for the particular trophy.

DESCRIPTION OF THE PREFERRED EMBODIMENT

Figure 1:
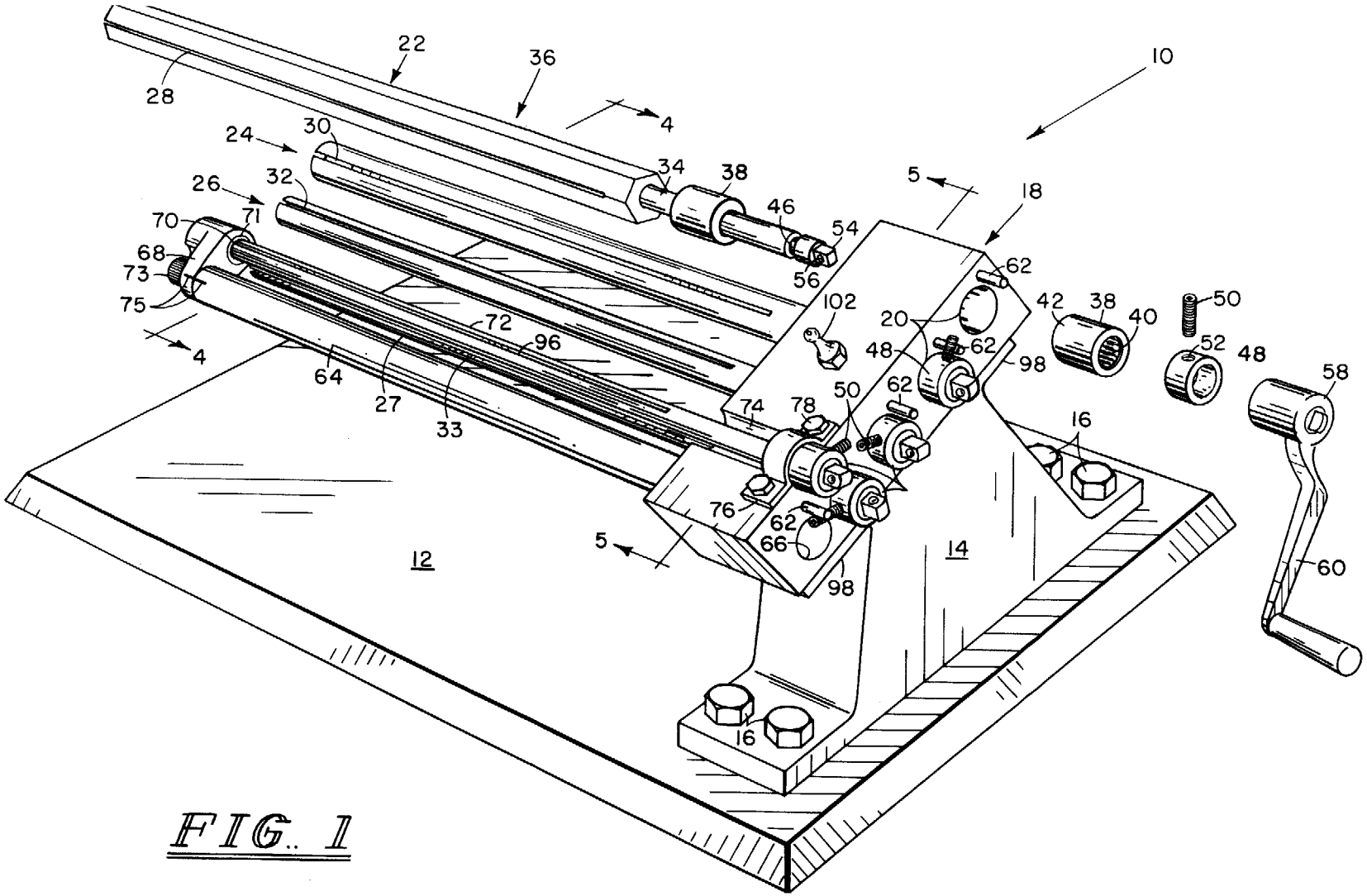
FIG. 1 is a perspective view of a sheet metal former with one roller being exploded therefrom and one roller removed.

Referring to FIG. 1 of the drawings, a perspective view of a sheet metal forming apparatus represented generally by reference 10 is shown. The sheet metal forming apparatus 10 is mounted on a base 12 by a support structure 14 attached thereto by means of bolts 16. Attached to the support structure 14 is a stationary bearing housing 18 with a plurality of holes 20 extending therethrough. A plurality of rollers 22, 24, 26 and 27 extend through the holes 20 in a manner as will be subsequently described in more detail. Each of the rollers 22, 24, 26 and 27 have slots 28, 30, 32 and 33, respectively, cut therein and extending along each respective longitudinal axis.

As can be seen from roller 22, which is in the shape of a hexagon, there is a bearing surface portion 34 that is reduced in diameter from a sheet metal forming portion 36. The bearing surface portion 34 extends through the holes 20 in the stationary bearing housing 18 and bearings 38 secured in each end of holes 20 by press fits. While many different type of bearings may be used, applicant plans to use a pair of elongated bearings having a plurality of needle bearings 40 inside cylinder 42. The bearings 38 are inserted in each end of holes 20 by a force fit so that the bearings 38 will reamin in the stationary bearing housing 18. The bearing surface portion 34 is inserted into the stationary housing 18 through the bearings 38 located in holes 20. Extending through the stationary bearing housing 18 is a circular groove 46 cut in the roller 22. A retaining collar 48 encircles the circular groove 46 with an allen screw 50 extending through the threaded hole 52 to press against the circular groove 46. By loosening the allen screw 50, the retaining collar 48 may be rotated on roller 22.

Extending through retaining collar 48 is a socket connection 54 having a spring loaded socket key 56 located therein. The socket connection 54 may receive the socket head 58 of handle 60 thereon in the normal manner for connecting socket wrenches.

Each of the other rollers 24, 26 and 27 are similarly mounted in the stationary bearing housing 18. Immediately adjacent to the holes 20 are pins 62 extending parallel therewith. The pins 62 limit the rotational movement of the rollers 22, 24, 26 and 27 because the allen screw 50 will hit the respective pin 62. By loosening the allen screw 50, the retaining collar 48 may be rotatably adjusted to fix the arc through which a roller may turn with sheet metal being formed thereon before the allen screw hits the respective pin 62.

A supporting bar 64 is rigidly connected to the stationary bearing housing 18 by a force fit in hole 66. Connected on the end of the supporting bar 64 is a supporting plate 68 with a hole 70 therein. The hole 70 has a bearing 71 therein which may be of a suitable brass substance. A threaded cap 73 threadably connected to supporting bar 64 holds the supporting plate 68 in position.

A small roller 72 is slideably received inside of hole 70 at one end thereof. The opposite end of the small roller 72 is mounted in stationary bearing housing 18 by means of a semicircular groove 74 and the mounting bracket 76 attached to the stationary bearing housing 18 by means of bolts 78. The mounting bracket 76 has a semicircular arc so that in combination with the semicircular groove 74, a complete circle is formed for receiving a bearing 108 of a small roller 72 therein (See FIG. 8). Like the previously described roller 22, a retaining collar 48 and allen screw 50 are located on the end of the small roller 72. Also, a pin 62 limits the rotational movement of the small roller 72.

If metal is being formed on roller 27, small roller 72 will be in the way and supporting plate 68 will obstruct the removal of metal formed on roller 27. By removing small roller 72 and loosening threaded cap 73, supporting plate 68 may be rotated out of the way. Notches 75 in supporting plate 68 and supporting bar 64 provide a means for realigning hole 70 with the circle receiving bearing 108 of small roller 72. Upon realignment, small roller 72 may be reinserted and used to form metal.

Figure 2:
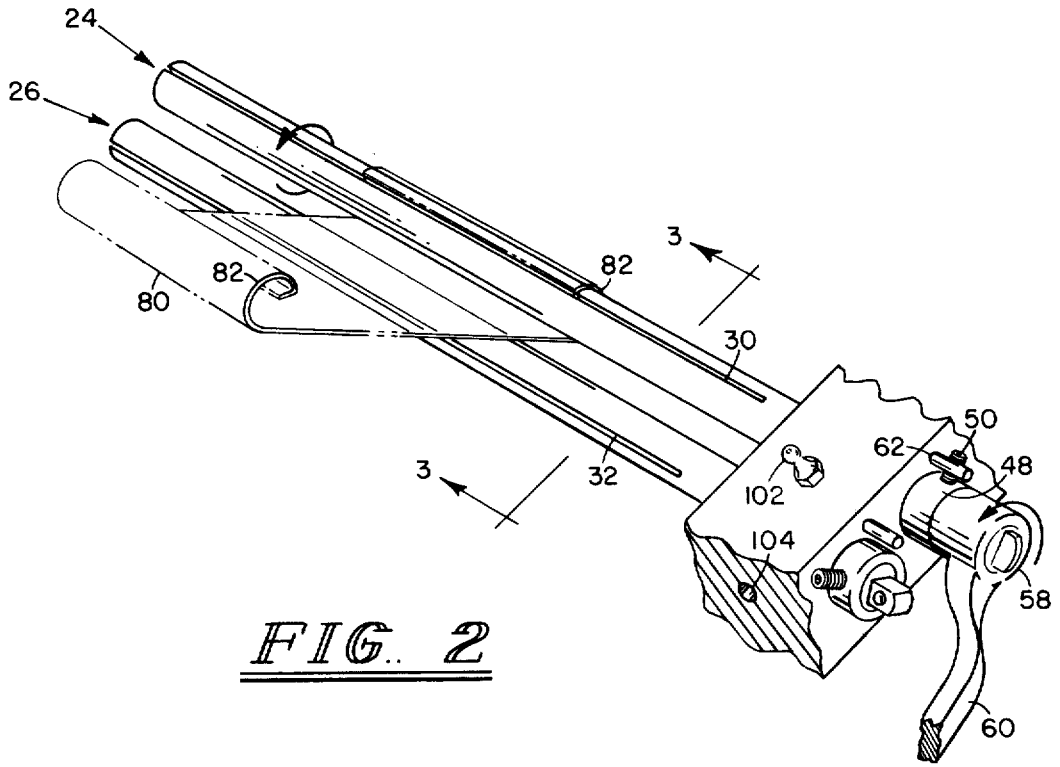
FIG. 2 is a partial perspective view of FIG. 1 with sheet metal being formed thereon.

Referring now to FIG. 2 of the drawings, rollers 24 and 26 are shown with sheet metal 70 being formed therein. First, an edge of the sheet metal 80 is inserted into slot 30 of roller 24. Roller 24 is then turned via handle 60 with the socket head 58 slideably receiving the socket connection 54 (See FIG. 1) therein. The retaining collar 48 may be set by loosening allen screw 50 and rotating the retaining collar 48 so that the arc 82 formed in sheet metal 80 will be for a predetermined number of degrees. As the handle 60 turns, the arc 82 will be formed in the sheet metal 80 by the sheet metal 80 pressing against the adjacent roller 26. The arc 82 will wrap around roller 24 as it is turned. When the allen screw 50 hits pin 62, the arc 82 has been formed through the predetermined number of degrees. The sheet metal 80 may then be removed from the roller 24 by sliding it to the left off the open end thereof.

Figure 3:
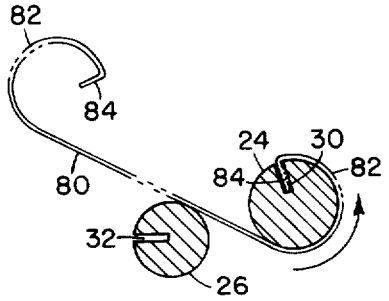
FIG. 3 is a sectional view of FIG. 2 along section line 3—3.
Figure 9:
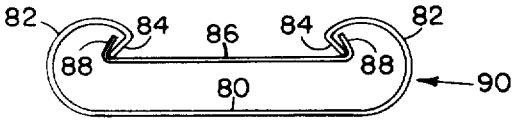
FIG. 9 is a top view of an illustrative, formed, assembled column.

The size of the roller 24 determines the radius of the arc 82. In the trophy industry, two opposing sides of sheet metal are formed for clamping with a second piece of sheet metal as can be seen in the cross-sectional view of FIG. 9. The portion of the sheet metal 80 that is inserted into the slot 30 forms a retaining flange 84 so that when a mating piece of sheet metal 86 is inserted therein as shown in FIG. 9, the two pieces of sheet metal 80 and 86 are securely held in position by their respective retaining flanges 84 and 88. FIG. 9 is a top view of a completed column 90 for use in the construction of a trophy. The forming of the sheet metal 80 can be seen in the cross-sectional view of FIG. 3 in conjunction with the previously described FIG. 2.

Figure 4:
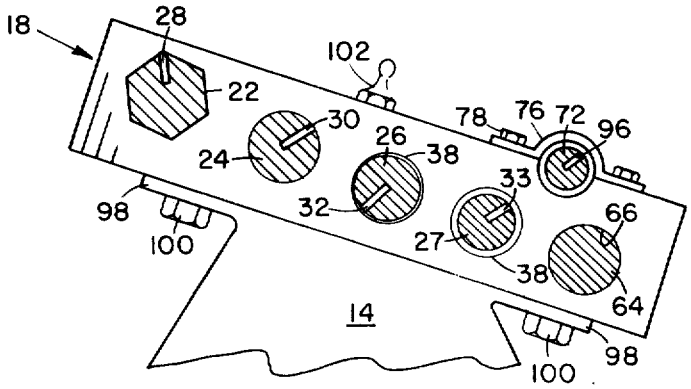
FIG. 4 is a partial sectional view of FIG. 1 along section line 4—4.

Since many different sized and shaped arcs may be desirable, a variety of rollers are necessary. By referring to FIG. 4, a cross-sectional view of some of the possible rollers is shown. Roller 22 is generally hexagonal in shape, with the sheet metal to be formed being inserted in slot 28. In the trophy making business, typical size rollers would be ½ in., 1 in., 1¼ in. and 1½ in. However, the size of the rollers may vary depending upon the particular requirements. In FIG. 4, roller 24 would have a diameter of approximately 1½ in., roller 26 would have a diameter of approximately 1¼ in., roller 27 would hve a diameter of approximately 1 in., and small roller 72 would have a diameter of approximately ½ in. Just as rollers 24 and 26 may receive the sheet metal in slots 30 and 32, respectively, roller 27 may receive the sheet metal in slot 33 and small roller 72 may receive the sheet metal in slot 96. An outer edge of the bearings 38 retaining rollers 26 and 27 in stationary bearing housing 18 can be seen in FIG. 4.

While the support structure 14 may be connected to the stationary bearing housing 18 by any suitable means, flanges 98 may extend outward from the base support structure 14 and be threadably connected by bolts 100 to the stationary bearing housing 18.

Figure 5:
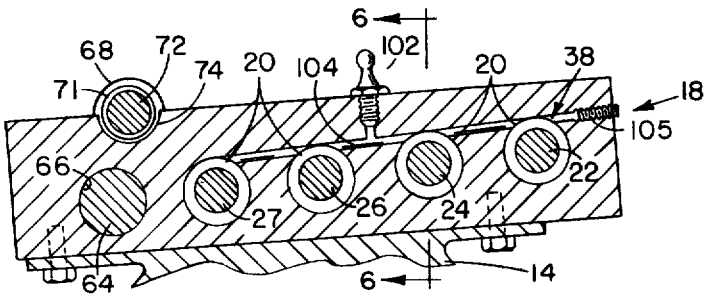
FIG. 5 is a partial sectional view of FIG. 1 along section lines 5—5.
Figure 6:
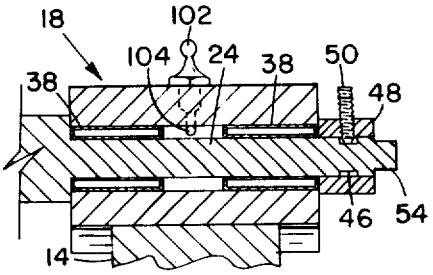
FIG. 6 is a sectional view of FIG. 5 along section lines 6—6.

Referring to FIGS. 5 and 6 in combination, a better understanding of the stationary bearing housing 18 and the mounting of the rollers therein can be obtained. There is a space in each of the holes 28 between the respective pair of the bearings 38 with the sectional view of FIG. 5 being taken between the pair of bearings 38. In the space between the bearings 38, a lubricant such as grease may be injected through grease fitting 102 and connecting passage 104.

Since it is preferable to have grease fitting 102 at the top of the stationary bearing housing 18, and because connecting passage 104 may be drilled from a side of stationary bearing housing 18, the end of connecting passage 104 is plugged by screw 105, or any other suitable means. Referring to FIG. 6, the space between bearings 38 in which grease is inserted can be seen. Further, the locating of the retaining collar 48 by means of the allen screw 50 is shown.

Figure 7:
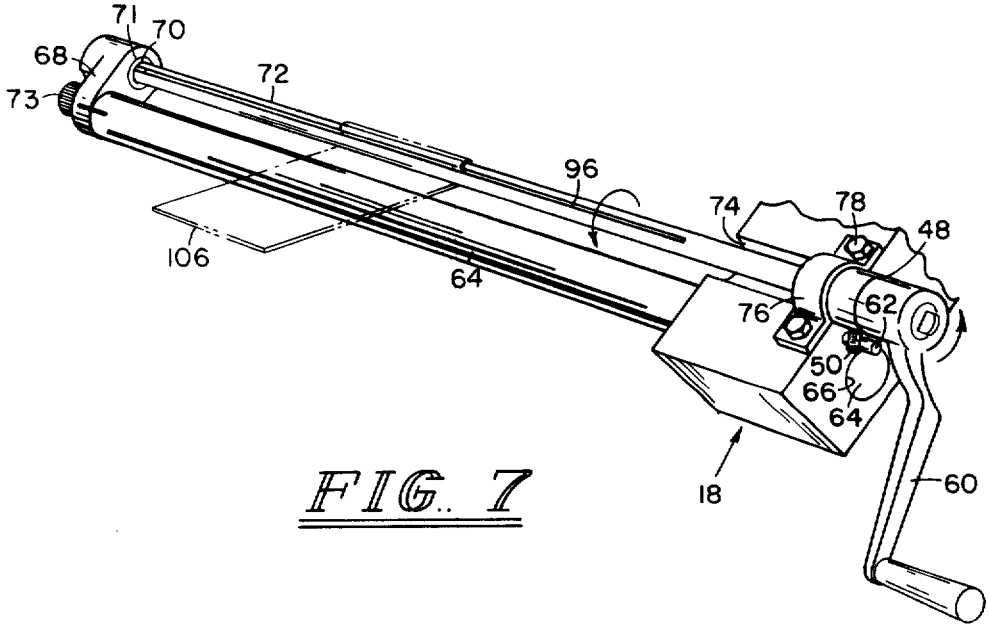
FIG. 7 is a partial perspective view of FIG. 1 illustrating the forming of metal on the small roller.
Figure 8:
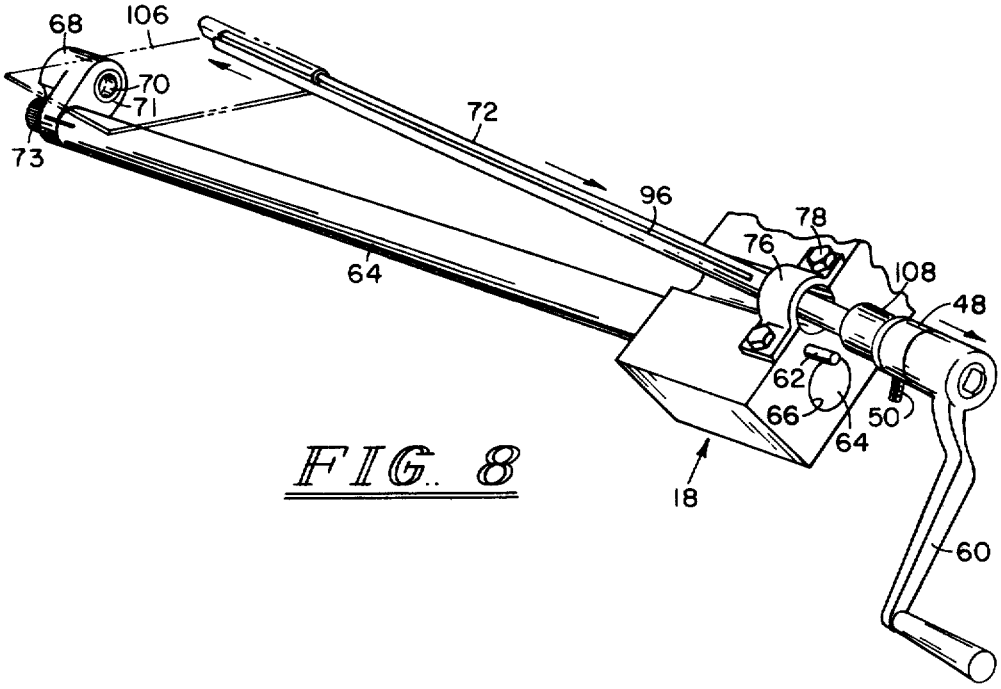
FIG. 8 is a partial sectional view of FIG. 1 illustrating the removal of sheet metal formed on the small roller.

Referring now to FIGS. 7 and 8 in combination, the small roller 72 is shown with sheet metal 106 being formed thereon. One edge of the sheet metal 106 is inserted in slot 96. By turning of handle 60, the small roller 72 is turned inside of bearing 71 located in hole 70 of supporting plate 68, and inside of the circle formed by the mounting bracket 76 and semicircular groove 74. The bearing element 108 which always is larger in diameter than the small roller 72 is held in position by the mounting bracket 76, which bearing element 108 can be seen in FIG. 8. After the roller 72 has been turned a predetermined distance as set in the retaining collar 48 by the allen screw 50 which strikes the pin 62, the sheet metal 106 is ready for removal. Thereafter, by moving the small roller 72 to the right, bearing 108 is no longer retained in mounting bracket 76, and the small roller 72 is removed from bearing 71 in hole 70 of supporting plate 68. Therefore, the small roller 72 may be pivoted slightly as shown in FIG. 8, and the sheet metal 106 formed thereon slid off of the open end of the roller 72.

For the forming of sheet metal on a small roller, such as small roller 72, it is important to have support on both ends of the roller. The small roller would typically be within a range of $\frac{3}{8}$ to $\frac{3}{4}$ of an inch in diameter. Naturally, all of the rollers as shown in the above described Figs. may be varied in cross-sectional diameter according to the particular requirements. The allen screw 50 may be unscrewed from circular groove 46 for removing the retaining collar 48 from any particular roller. Thereafter, the roller may simply be pulled out of the stationary bearing housing 18 and be replaced with any variety of interchangeable roller.

Concerning the slots that are contained in the respective rollers, the thickness of metal commonly used in the trophy industry is between 10 to 25 thousandths of an inch. It has been found that slots having a width of between 36 to 40 thousandths of an inch is small enough for retaining the sheet metal therein during forming, and yet still be large enough to allow for easy insertion of the metal to be formed into the slots.

It has also been found that approximately a 12° spring back will exist in typical metals used in the trophy industry. A roller can be used for forming 90° bends at at least three corners by having three adjacent corners of approximately 78° on which the sheet metal will be formed. Thereafter, when the formed metal is removed from the roller, each of the three corners formed thereon will spring back to approximately 90°.

I claim:

1. An apparatus for forming sheet metal comprising:
base means;
bearing support means attached to said base means;
plurality of roller means being rotatably anchored near a first end thereof by said bearing support means, said first end extending through said bearing support means, a second end of said roller means being open;
slot means in said roller means extending along its longitudinal axis from said second end for receiving said sheet metal therein;
said plurality of roller means being arranged, one to the other, to enable a first of said roller means to serve as stop means for sheet metal inserted within a second of said roller means adjacent thereto, said sheet metal being bent upon said first roller means;
handle means connected to said roller means for rotating said roller means to form said sheet metal thereon, formed sheet metal being slideably removed off said second end.

2. The apparatus of claim 1 wherein said bearing support means includes bearing means along said first end of said roller means, said bearing means extending around said longitudinal axis a sufficient distance to support said roller means.

3. The apparatus of claim 2 wherein said bearing means include at least a pair of said bearing means located inside each end of holes through said bearing support means, said holes receiving said first end of said roller means therein.

4. The apparatus of claim 3 comprising lubricating means connected to said holes having said bearing means therein by passage means in said bearing support means.

5. The apparatus of claim 1 comprising means for indexing said roller means to prevent rotation for forming said sheet metal thereon beyond a predetermined arc.

6. An apparatus for forming sheet metal comprising:
base means;
support means attached to said base means;
plurality of roller means being rotatably anchored near a first end thereof by said support means, said first end extending through said support means, a second end of said roller means being open;
slot means in said roller means extending along its longitudinal axis from said second end for receiving said sheet metal therein;
handle means connected to said roller means for rotating said roller means to form said sheet metal thereon, formed sheet metal being slideably removed off said second end;
a first of said roller means being of a reduced diameter to require support on said second end thereof, said first roller means being moveable in a direction of said first end and pivotable in said bearing support means so that said sheet metal formed thereon may be slideably removed off said second end.

7. The apparatus of claim 6 comprising clamp means attached to said bearing support means for rotatably holding said first roller means therein, said supporting plate means being secured to stationary arm means extending from said bearing support means parallel to said first roller means, said second end of said first roller means being removably received in a hole in said supporting plate means.

8. An apparatus for forming sheet metal comprising:

base means;

bearing support means attached to said base means;

plurality of roller means being rotatably anchored near a first end thereof by said bearing support means, said first end extending through said bearing support means, a second end of said roller means being open;

slot means in said roller means extending along its longitudinal axis from said second end for receiving said sheet metal therein;

handle means connected to said roller means for rotating said roller means to form said sheet metal thereon, formed sheet metal being slideably removed off said second end;

indexing means for limiting rotation of said roller means for forming sheet metal thereon to a predetermined arc, wherein said indexing means includes a retaining collar on said first end with screw means threadably extending therethrough to said roller means, said screw means setting said predetermined arc in conjunction with stop means of said bearing support means, said screw means anchoring said roller means in said bearing support means.

9. The apparatus of claim 8 wherein said handle means and said roller means have mating socket connections.

* * * * *